United States Patent [19]

Roberts

[11] 4,106,133

[45] Aug. 15, 1978

[54] CONTAMINATION PREVENTION DEVICE FOR SITZ BATH

[76] Inventor: Thomas J. Roberts, 1233 Somerset La., Elk Grove, Ill. 60007

[21] Appl. No.: 795,408

[22] Filed: May 9, 1977

[51] Int. Cl.[2] ..... A47K 3/22

[52] U.S. Cl. ..... 4/6; 4/173 R; 4/201; 4/DIG. 18

[58] Field of Search ..... 4/6, 173 R, 175, 177, 4/201, DIG. 18, 172 R, 172.19

[56] References Cited

U.S. PATENT DOCUMENTS

| | | | |
|---|---|---|---|
| 2,483,789 | 10/1949 | Smith et al. | 4/177 |
| 2,817,851 | 12/1957 | Barnwell | 4/DIG. 18 |
| 2,988,755 | 6/1961 | Roland | 4/201 |
| 3,457,570 | 7/1969 | Williams | 4/295 |
| 3,648,296 | 3/1972 | Craft et al. | 4/173 |
| 3,744,198 | 7/1973 | Boassy | 4/172 X |
| 3,931,651 | 1/1976 | Weir | 4/173 |
| 3,938,200 | 2/1976 | Roberts et al. | 4/DIG. 18 |

*Primary Examiner*—Charles E. Phillips
*Attorney, Agent, or Firm*—James E. Tracy

[57] ABSTRACT

Cross-contamination of the patients using the same sitz bath in a health-care institution is precluded by lining the bath with a disposable sheet of biologically-clean, flexible plastic film, thereby establishing a physical barrier to prevent any contact (and consequently a transmission path for bacteria) between the sitz bath and patient and between the bath and water. A plastic collar or grommet, which surrounds and extends through a drain opening in the liner, inserts into the bath's drain. Water may be run continuously into the lined sitz bath and drained out through the collared drain opening. To provide a predetermined water level in the sitz bath, a plastic standpipe is inserted into, and held by, the plastic collar.

1 Claim, 9 Drawing Figures

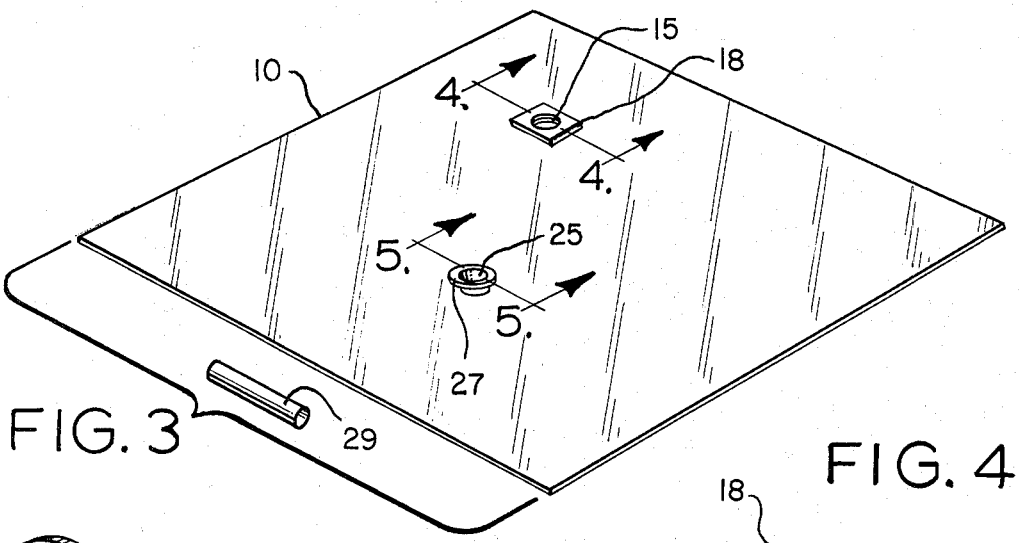
FIG. 3
FIG. 4
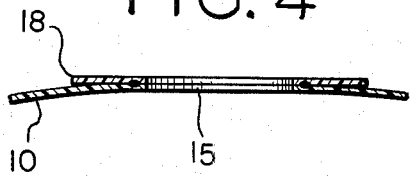
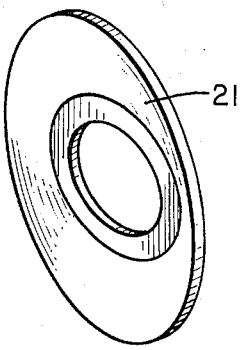
FIG. 6
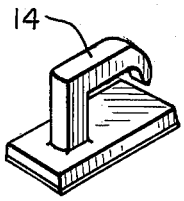
FIG. 7
FIG. 5
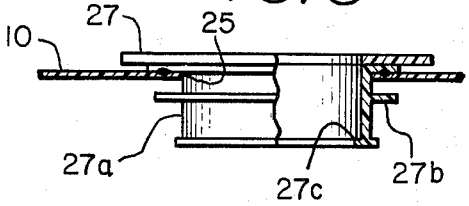
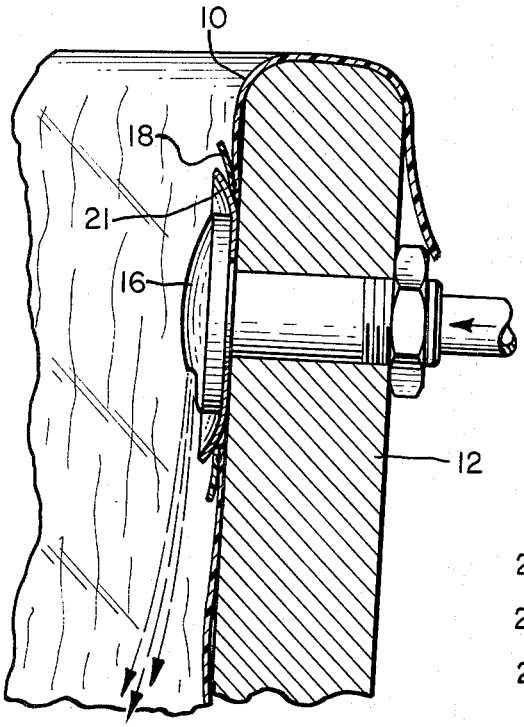
FIG. 8
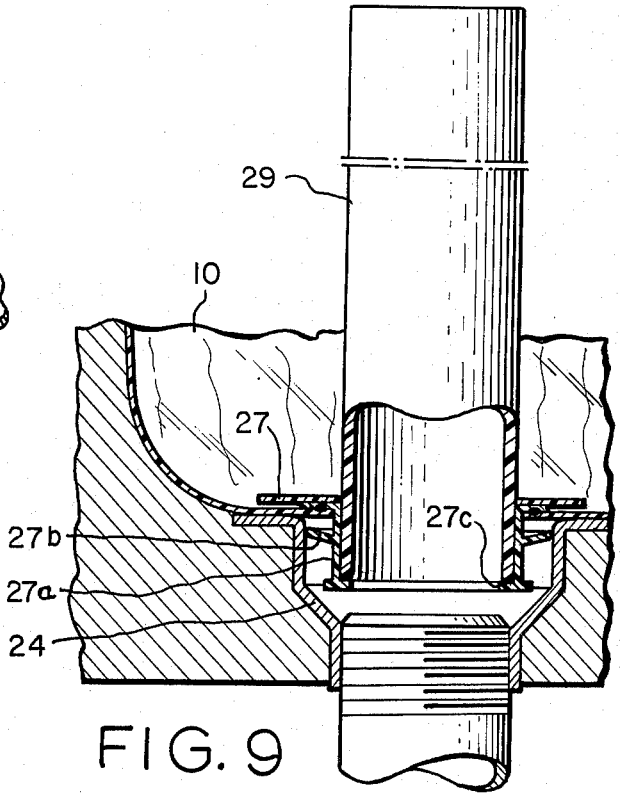
FIG. 9

CONTAMINATION PREVENTION DEVICE FOR SITZ BATH

BACKGROUND OF THE INVENTION

Since many of the patients that use sitz baths in a health-care institution, such as a hospital, may have open wounds or may be highly susceptible or vulnerable to infection-causing bacteria, it is imperative that those sitz baths be thoroughly cleaned and sterilized each time they are used so that the patients will not become infected. Unfortunately, complete sterilization of stiz baths is a time-consuming task. All of the surfaces of the bath that the patient may contact, or that may be in contact with the water, must be brush cleaned. Soaking in a germ-killing solution is not enough.

The present invention provides a low-cost contamination prevention device which obviates the need to sterilize a stiz bath each time it is used. With the uniquely constructed and easily installed device of the invention, it is impossible for any bacteria to be transferred from a sitz bath to a patient, even though the bath is not sterilized. By the same token, there is also no way for bacteria to be conveyed from that patient to the sitz bath.

SUMMARY OF THE INVENTION

The contamination prevention device of the invention is to be installed in a sitz bath in a health-care institution to prevent the various patients that use the sitz bath from cross-infecting each other. The device comprises a disposable, flexible water-tight liner, made of plastic film, for lining the inside of the sitz bath, while at the same time allowing water to flow continuously into the bath through the bath's water inlet. The liner thereby provides a barrier to block the transmission of bacteria between the water and sitz bath to preclude cross-infections between patients. A plastic collar attaches to, and surrounds a drain opening in, the liner, the opening and collar being located such that a portion of the collar may be inserted into the bath's drain. A removable plastic standpipe is inserted into, and is supported by, the collar. With this arrangement, the water, which flows constantly into the lined sitz bath, is drained off at the top of the standpipe, the water level in the bath thereby being determined by the height of the standpipe.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

FIG. 3 is a perspective view of portions of the contamination prevention device; specifically, it discloses the plastic film liner, collar and standpipe;

FIG. 4 is a sectional view taken along the plane of section line 4—4 in FIG. 3;

FIG. 5 is a sectional view taken along the plane of section line 5—5 in FIG. 3;

FIG. 6 shows an element, specifically a diverter, which is preferably mounted to the sitz bath;

FIG. 7 is a perspective view illustrating a plastic hook which is also preferably attached to the sitz bath;

FIG. 8 is a sectional view illustrating the manner in which the liner is attached to the water inlet and diverter; and, FIG. 9 is a sectional view depicting the manner in which the standpipe attaches to the collar.

DESCRIPTION OF THE ILLUSTRATED EMBODIMENT

Figure 1:
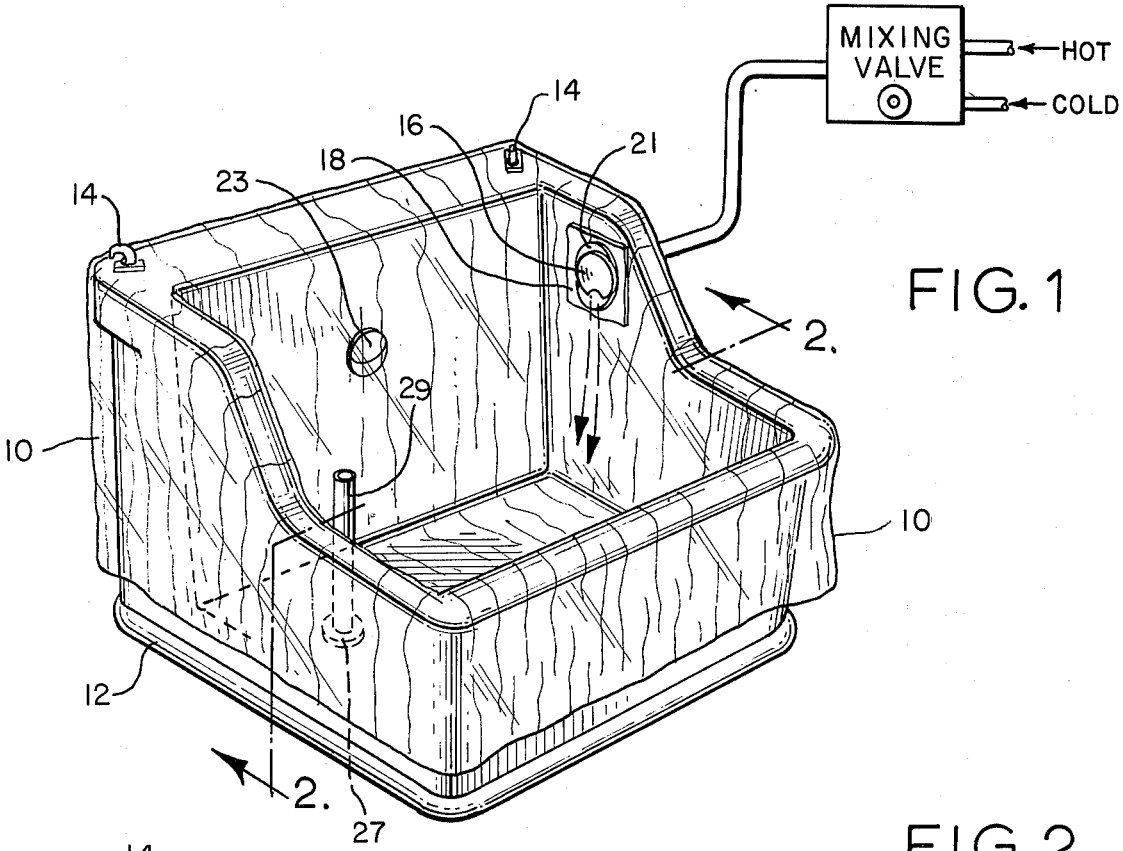
FIG. 1 is a perspective view of a sitz bath having installed therein a contamination prevention device constructed in accordance with the invention.
Figure 2:
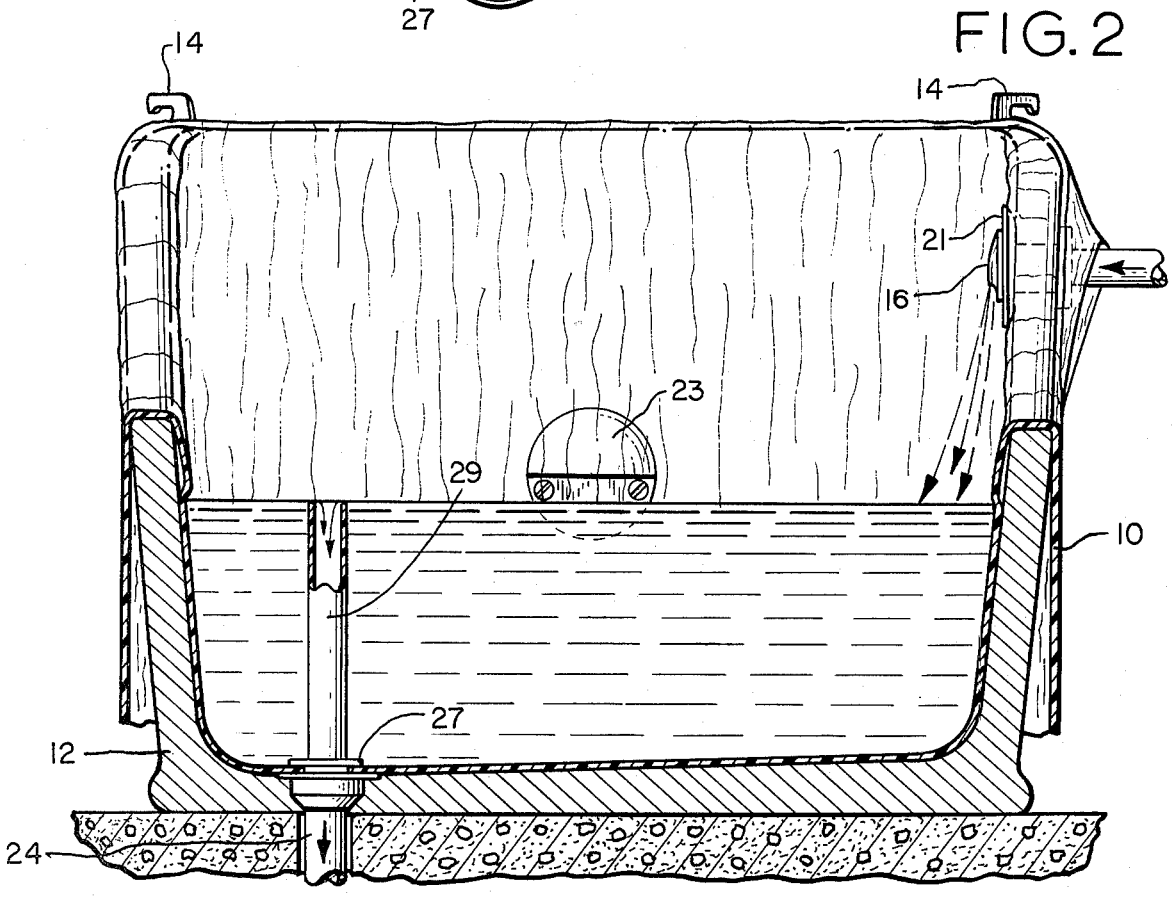
FIG. 2 is a sectional view taken along the plane of section line 2—2 in FIG. 1.

The principal element of the contamination prevention device is the liner 10 which preferably takes the form of a disposable, flexible, flimsy, water-tight, nontoxic, slip-resistance, biologically-clean sheet of transparent polyethylene plastic. It should have a thickness of less than 4 mils or 0.004 inches. Excellent results have been achieved with a specific thickness of 1.75 mils. furthermore, plastic film liner 10 should not contain any leachables. In other words, there should be no ingredients that will bleed or dissolve into the water.

Liner 10 is, of course, placed inside of sitz bath 12 before the water is turned on. As shown, sitz bath 12 is free standing so liner 10 merely may be draped over the four walls or sides of the sitz bath. In many installations, however, the sitz bath will be mounted against a wall and for that reason a pair of hooks 14 are provided on which liner 10 may be hung. Hooks 14, one of which is shown in detail in FIG. 7, are preferably made of plastic and are affixed, such as by cementing, to the top of the back wall of the sitz bath. To hang the liner from hooks 14, the installer uses the hooks themselves to pierce or puncture the liner to provide the necessary openings to hang onto the hooks. As best seen in FIG. 7, plastic hooks 14 are sufficiently pointed to facilitate piercing of liner 10, but yet are sufficiently blunt and are appropriately shaped so that a patient will not be injured.

A hole 15 is provided in liner 10 to permit the liner to be placed over the sitz bath's water inlet 16. Preferably, the hole diameter is approximately the same as the diameter of the water inlet. To reenforce and strengthen the liner around hole 15, a double thickness is provided by means of the small piece of plastic film 18. This is best seen in FIGS. 3 and 4. Piece 18 may be attached to liner 10 by heat sealing. Since the water inlet in a conventional sitz bath may be very close to one of the bath's walls, an adapter or diverter 21 (shown by itself in FIG. 6 and preferably made of stainless steel) may be employed to make certain that the incoming water flows into the lined sitz bath rather than behind the liner. In addition, the diverter also serves as a hook from which the liner may be hung. This is achieved by shaping diverter 21 so that is has a dished elliptical configuration and mounting it between water inlet 16 and the side wall of the bath. In attaching liner 10, the portion around the lower half of hole 15 is first placed behind the lower end portion of diverter 21 (best seen in FIG. 8) and then the portion of liner 10 around the upper half is stretched slightly and hooked behind the upper end of the diverter. In this way, the water flowing from inlet 16 will be diverted into the lined sitz bath and there is no possibility of water flowing between the lining and the side wall.

Oftentimes, when a sitz bath is in use, it is desired to run water continuously into the bath and to drain it out through an overflow so that circulating water at a predetermined water depth or level will be maintained. In this way, the water will be circulating and changing constantly. Overflow drain 23 may be employed for this purpose in a conventional unlined sitz bath. Of course, drain 24, at the bottom of the sitz bath, would then have to be closed or stopped in any convenient manner. If a water level less than the height of overflow drain 23 (whose primary function is to prevent overfilling of the bath) is desired in a conventional unlined sitz bath, drain 24 must be partially opened and the incoming water flow must be properly adjusted to establish the desired water depth. With the present invention, an overflow drain arrangement is provided to allow the running water to drain off at any desired level, while at the same time insuring that a patient using the sitz bath will be completely isolated from the bath, and its associated hardware, so that no bacteria can be transferred to or from the patient. Of course, with liner 10 installed in the sitz bath, overflow 23 is covered and not used.

In accordance with a feature of the invention, a biologically-clean overflow drain, at a desired height, is provided by a plastic collar and a standpipe. More specifically, a drain opening 25 is made in liner 10 and is surrounded by a plastic collar or grommet 27. The collar, which may be attached to the liner by heat sealing, has a cylindrical section **27*a* which is inserted into the sitz bath's drain 24. Annular ring 27*b*** on the external surface of the cylindrical section provides a sealing ring.

The portion of collar 27 that extends into drain 24 (namely cylindrical section **27*a*) has a circumferential lip 27*c* around its internal surface to provide a support for removable plastic standpipe 29 which is inserted into collar 27. In other words, collar 27 provides a socket for standpipe 29. While not shown in the drawings, the internal cylindrical surface of cylindrical section 27*a* may be very slightly tapered to insure a snug fit for standpipe 29**. The water level is, of course, determined by the height of the standpipe since the flowing water drains off at the top of he standpipe. If different water levels are desired for different patients, it is merely necessary to use different length standpipes. Such a flexibility and convenience is not available in the absence of the invention.

The invention provides, therefor, a unique and easily installed contamination prevention device for insuring that absolutely no bacteria will be transferred to or from a patient when he uses a sitz bath in a health-care institution. This result is achieved since the liner and its associated plastic elements provide an excellent barrier to block the transmission of bacteria so that there is no way for bacteria to travel from the sitz bath to the patient or vice versa. Hence, cross-infections between the various patients using the sitz bath are precluded. At the conclusion of the bath, the incoming water is turned off and the water in the lined bath is drained merely by removing the standpipe. The liner, collar and standpipe are then disposed of since they will now be contaminated with bacteria from the patient.

While a particular embodiment of the invention has been shown and described, modifications may be made, and it is intended in the appended claims to cover all such modifications as may fall within the true spirit and scope of the invention.

I claim:

1. A sitz bath arrangement comprising:

a sitz bath having sidewalls and a bottom;

a drain in the bottom of said sitz bath;

a water inlet extending through one of the sidewalls of said sitz bath;

a generally elliptical shaped diverter mounted on and surrounding said water inlet on the inside of the sitz bath and adjacent to the sidewall through which the inlet extends, said diverter being oriented such that its major axis is generally vertically aligned and said diverter being dished so that its two end portions extend away from the adjacent sidewall;

a disposable, flexible water-tight liner, made of plastic film, for lining the inside of said sitz bath and having a hole which permits the liner to be placed over the water inlet and hung on said diverter, said liner being placed behind both end portions of said diverter to insure that the incoming water, which may flow continuously through said water inlet, runs into the lined sitz bath and not behind said liner, said liner providing a barrier to block the transmission of bacteria between the water and sitz bath to preclude cross-infections between the various patients that use the sitz bath;

a plastic collar attached to and surrounding a drain opening in said liner and having a depending cylindrical section that extends into the sitz bath's drain in order to communicate the liner's drain opening with the bath's drain, an annular ring being formed on the external surface of said cylindrical section to provide a sealing ring, said cylindrical section having a circumferential lip extending around its internal cylindrical surface to provide a support;

and a removable plastic standpipe which is inserted into said collar and is supported on said circumferential lip, the water, which flows constantly into the lined sitz bath, being drained off at the top of said standpipe, the water level in the bath thereby being determined by the height of the standpipe.

* * * * *